US005962396A

United States Patent [19]

Pollack et al.

[11] Patent Number: 5,962,396

[45] Date of Patent: Oct. 5, 1999

[54] POST FORMING CLEANING COMPOSITIONS COMPRISING ISOPENTANE

[75] Inventors: Charles Pollack, South Plainfield; Gilbert Gomes, Somerset, both of N.J.

[73] Assignee: Colgate-Palmolive Co., Piscataway, N.J.

[21] Appl. No.: 09/289,462

[22] Filed: Apr. 9, 1999

[51] Int. Cl.[6] ..... C11D 17/00; C11D 9/00

[52] U.S. Cl. ..... 510/433; 510/218; 510/235; 510/435; 510/437; 510/491; 510/503; 510/505

[58] Field of Search ..... 510/218, 235, 510/437, 435, 433, 491, 503, 505

[56] References Cited

U.S. PATENT DOCUMENTS

| | | | |
|---|---|---|---|
| 4,726,944 | 2/1988 | Osipow et al. | 424/70 |
| 4,744,979 | 5/1988 | Osipow et al. | 424/73 |
| 5,186,857 | 2/1993 | Ramirez et al. | 252/167 |

*Primary Examiner*—Yogendra Gupta
*Assistant Examiner*—Necholus Ogden
*Attorney, Agent, or Firm*—Richard E. Nanfeldt

[57] ABSTRACT

A post foaming liquid cleaning composition is sprayed onto a surface to be cleaned and then the composition foams while on the surface.

1 Claim, No Drawings

POST FORMING CLEANING COMPOSITIONS COMPRISING ISOPENTANE

FIELD OF THE INVENTION

This invention relates to a post foaming cleaning composition which is sprayed onto the surface to be cleaned and the composition then foams on the surface being cleaned.

BACKGROUND OF THE INVENTION

The present invention relates to novel light duty liquid detergent compositions with post foaming properties, containing at least one surfactant, isopentane and water.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

U.S. Pat. Nos. 4,675,422; 4,698,181; 4,724,174; 4,770,815 and 4,921,942 disclose alkyl succinamates but the compositions are non related to light duty liquid compositions.

However, none of these patents teach a composition which can be sprayed onto a surface, wherein the composition will then foam on the surface being cleaned.

SUMMARY OF THE INVENTION

The present invention relates to the herein after described post foaming compositions which are dispensed from a container as a spray onto a surface, wherein the post foaming composition contacts the surface as a liquid and begins to foam within a few seconds without the mechanical action or running water or squeezing a sponge.

The instant post foaming compositions are packaged in a pressurized fluid dispenser such as illustrated in U.S. Pat. No. 4,964,540, which is incorporated by reference herein in its entirety. One pressurized fluid dispenser can be generally described as an expandable bag having a generally cylindrical shaped outer wall, said bag having a closed end and an open end, said outer wall including a plurality of substantially longitudinal pleats, said pleats defining a plurality of peaks and valleys; valve means coupled with said open end for selectively releasing the contents of the bag; an expandable energy tube substantially surrounding said bag for maintaining pressure on the bag and its contents; a plurality of expandable longitudinal ribs disposed in said valleys of said pleats and at least partially filing said valleys, said longitudinal ribs controlling refolding of the pleats in the bag as fluid is released from the bag.

DETAILED DESCRIPTION OF THE INVENTION

The present invention relates to a post foaming light duty liquid cleaning composition comprising approximately by weight:

(a) 8% to 39% of at least one sulfonate surfactant selected from the group consisting of sodium or magnesium salt of a linear $C_8$–$C_{18}$ alkyl benzene sulfonate and sodium magnesium salt of a $C_8$–$C_{18}$ paraffin sulfonate and mixtures thereof;

(b) 2% to 24% of at least one ethoxylated alkyl ether sulfate selected from the group consisting of sodium ethoxylated $C_8$–$C_{18}$ alkyl ether sulfate ammonium ethoxylated $C_8$–$C_{18}$ alkyl ether sulfate and sodium ethoxylated $C_8$–$C_{18}$ alkyl ether sulfate and mixtures thereof;

(c) 0 to 10% of a surfactant selected from the group consisting of betaine surfactants and amine oxide surfactants and mixtures thereof;

(d) 1% to 16% of an alkyl polyglucoside;

(e) 0 to 4% of a mono- or di-alkanol amide;

(f) 0 to 20% of an ethoxylated nonionic surfactant;

(g) 0 to 0.6% of a fragrance;

(h) 7% to 14% of isopentane; and (i) 60% to 80% of water.

The present invention also relates to a post foaming microemulsion cleaning surface composition which comprises approximately by weight:

(a) 2% to 12% of a sulfonate surfactant selected from the group consisting of a sodium or magnesium salt of a $C_8$–$C_{18}$ linear alkyl benzene sulfonates and a sodium or magnesium salt of a $C_8$–$C_{18}$ paraffin sulfonates and mixtures thereof;

(b) 0 to 8% of a magnesium, sodium or ammonium salt of an ethoxylated $C_8$–$C_{18}$ alkyl ether sulfate and mixtures thereof;

(c) 0 to 8% of a zwitterionic surfactant;

(d) 0 to 10% of a glycol ether cosurfactant;

(e) 0.4% to 8% of a perfume, essential oil or water insoluble saturated or unsaturated organic compound having about 8 to about 24 carbon atoms, and mixtures thereof;

(f) 7% to 14% of isopentane; and (g) 75% to 95% of water.

The present invention also relates to a post foaming microemulsion cleaning composition comprising approximately by weight:

(a) 0.2% to 10% of a sodium salt of a $C_6$–$C_{10}$ alkyl sulfosuccinate;

(b) 10% to 16% of at least one nonionic surfactant containing ethoxylate groups;

(c) 1% to 15% of a glycol ether cosurfactant;

(d) 1% to 8% of a water insoluble saturated or unsaturated organic compound having about 8 to about 24 carbon atoms and/or an essential oil;

(e) 0 to 2% of a perfume;

(f) 7% to 14% of isopentane; and (g) 70% to 90% of water.

The present invention also relates to a post foaming super wetting cleaning composition comprising approximately by weight:

(a) 1% to 8% of a nonionic surfactant containing ethoxylate groups;

(b) 0 to 4 wt. % of a perfume;

(c) 1% to 8% of a water insoluble saturated or unsaturated organic compound having about 8 to about 24 carbon atoms and/or an essential oil;

(d) 1% to 12% of an amphipile which is the condensation product of an alkanol having about 4 to about 8 carbon atoms with about 2 to about 4 moles of ethylene oxide;

(e) 7% to 14% of isopentane; and (f) 75% to 95% of water.

The present invention also relates to post foaming all purpose cleaning composition comprising approximately by weight:

(a) 10% to 24% of a tall oil fatty acid;

(b) 2% to 10% of potassium hydroxide;

(c) 0.1% to 5% of amine oxide;

(d) 0.1% to 5% of a sultaine;

(e) 7% to 14% of isopentane; and (f) 75% to 95% of water.

The $C_{8-18}$ ethoxylated alkyl ether sulfate surfactants used in the instant compositions have the structure:

$$R—(OCHCH_2)_nOSO_3—M^+$$

wherein n is about 1 to about 22 more preferably 1 to 3 and R is an alkyl group having about 8 to about 18 carbon atoms, more preferably 12 to 15 and natural cuts, for example, $C_{12-14}$; $C_{12-15}$ and M is an ammonium cation or an alkali metal cation, most preferably sodium or ammonium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These surfactants can be prepared by reacting an alkyl phenol with 2 to 6 moles of ethylene oxide and sulfating and neutralizing the resultant ethoxylated alkylphenol.

The linear alkyl benzene sulfonate contains from 10 to 16 carbon atoms in the alkyl group are used in the instant compositions wherein the alkyl benzene sulfonates has a high content of 3-(or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an alpha-olefin.

Other examples of suitable anionic sulfonate surfactants are the paraffin sulfonates containing about 10 to 20, preferably about 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

The alkyl polysaccharides surfactants, which are used in the instant compositions have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferably 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8–15 and give good O/W emulsification, whereas ethoxamers with HLB values below 8 contain less than 5 ethyleneoxide groups and tend to be poor emulsifiers and poor surfactants.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of dinonyl phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The preferred long chain unsaturated fatty acids such as tall oil fatty acid of the instant invention have about 8 to about 24 carbon atoms, more preferably about 10 to about 20 carbon atoms. A preferred unsaturated fatty acid mixture is a refined tall oil fatty acid. A typical tall oil fatty acid contains a mixture of a mono unsaturated $C_{16-18}$ fatty acid; a $C_{16-18}$ diene unsaturated fatty acid; a $C_{16-18}$ triene unsaturated fatty acid; and a $C_{16-18}$ saturated fatty acid. Other unsaturated fatty acids that are usable in the instant compositions are unsaturated vegetable oil fatty acids, including soy, peanut, corn, cottonseed, linseed and refined oleic fatty acids, and fatty acids consisting predominantly of $C_{18}$ (average) unsaturated fatty acids and mixtures thereof.

In the compositions of this invention, the sulfosuccinate is present as the monoalkylsuccinate which is depicted by the structure (MAS)

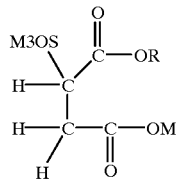

where R is an aliphatic radical, preferably alkyl, of from 10 to 18 carbon atoms, especially from 12 to 16 carbon atoms, and preferably lauryl ($C_{12}$), and M is a cation, such as an alkali metal, e.g. sodium or potassium, preferably sodium, ammonium, alkanolamine, e.g. ethanolamine, or magnesium. The alkyl radical may be ethoxylated with up to about 8 moles, preferably up to about 6 moles, on average, e.g. 2, 3, or 4 moles, of ethylene oxide, per mole of alkyl group.

The zwitterionic surfactant which are used in the instant compositions are water soluble betaines having the general formula:

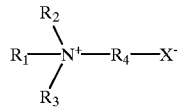

wherein $X^-$ is selected from the group consisting of $CO_2^-$ and $SO_3^-$ and $R_1$ is an alkyl group having 10 to about 20 carbon atoms, preferably 12 to 16 carbon atoms, or the amido radical:

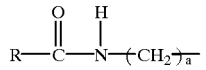

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine. Two preferred betaine surfactants are Rewoteric AMB 13 and Golmschmidt Betaine L7.

The sultaine used in the instant composition can be depicted by the formula:

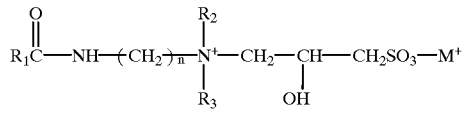

wherein $R_1$ is a saturated or unsaturated alkyl group having about 6 to about 24 carbon atoms, $R_2$ is a methyl or ethyl group, $R_3$ is a methyl or ethyl group, n is about 1 to about 6, and $M^+$ is an alkali metal cation. The most preferred hydroxysultaine is a potassium salt of cocoamidopropyl hydroxysultaine.

The amine oxides used in the instant composition are semi-polar nonionic surfactants which comprise compounds and mixtures of compounds having the formula

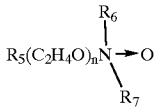

wherein $R_5$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_6$ and $R_7$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

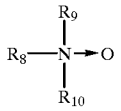

wherein $R_8$ is a $C_{12-16}$ alkyl group or amido radical:

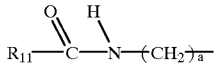

wherein $R_{11}$ is an alkyl group having about 9 to 19 carbon atoms and a is an integer 1 to 4 and $R_9$ and R10 are methyl or ethyl. The above ethylene oxide condensates, amides, and amine oxides are more fully described in U.S. Pat. No. 4,316,824 which is hereby incorporated herein by reference.

The water insoluble saturated or unsaturated organic compounds used in the instant compositions contain 4 to 30 carbon atoms and up to 4 different or identical functional groups. Examples of acceptable water insoluble saturated or unsaturated organic compound include (but are not limited to) water insoluble hydrocarbons containing 0 to 4 different or identical functional groups, water insoluble aromatic hydrocarbons containing 0 to 4 different or identical functional groups, water insoluble heterocyclic compounds containing 0 to 4 different or identical functional groups, water insoluble ethers containing 0 to 3 different or identical functional groups, water insoluble alcohols containing 0 to 3 different or identical functional groups, water insoluble amines containing 0 to 3 different or identical functional groups, water insoluble esters containing 0 to 3 different or identical functional groups, water insoluble carboxylic acids containing 0 to 3 different or identical functional groups, water insoluble amides containing 0 to 3 different or identical functional groups, water insoluble nitriles containing 0 to 3 different or identical functional group, water insoluble aldehydes containing 0 to 3 different or identical functional groups, water insoluble ketones containing 0 to 3 different or identical functional groups, water insoluble phenols containing 0 to 3 different or identical functional groups, water insoluble nitro compounds containing 0 to 3 different or identical functional groups, water insoluble halogens containing 0 to 3 different or identical functional groups, water insoluble sulfates or sulfonates containing 0 to 3 different or identical functional groups, limonene, dipentene, terpineol, essential oils, perfumes, water insoluble organic compounds containing up to 4 different or identical functional groups such as an alkyl cyclohexane having both three hydroxys and one ester group and mixture thereof.

Typical heterocyclic compounds are 2,5-dimethylhydrofuran,2-methyl-1,3-dioxolane, 2-ethyl 2-methyl 1,3 dioxolane, 3-ethyl 4-propyl tetrahydropyran, 3-morpholino-1,2-propanediol and N-isopropyl morpholine A typical amine is alphamethyl benzyldimethylamine. Typical halogens are 4-bromotoluene, butyl chloroform and methyl perchloropropane. Typical hydrocarbons are 1,3-dimethylcyclohexane, cyclohexyl-1 decane, methyl-3 cyclohexyl-9 nonane, methyl-3 cyclohexyl-6 nonane, dimethyl cycloheptane, trimethyl cyclopentane, ethyl-2 isopropyl-4 cyclohexane. Typical aromatic hydrocarbons are bromotoluene, diethyl benzene, cyclohexyl bromoxylene, ethyl-3 pentyl-4 toluene, tetrahydronaphthalene, nitrobenzene and methyl naphthalene. Typical water insoluble esters are benzyl acetate, dicyclopentadienylacetate, isononyl acetate, isobornyl acetate, isobutyl isobutyrate and, alipathic esters having the formula of:

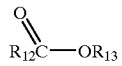

or

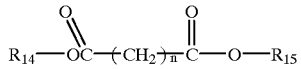

wherein $R_{12}$, $R_{14}$ and $R_{15}$ are $C_2$ to $C_8$ alkyl groups, more preferably $C_3$ to $C_7$ alkyl groups and $R_{13}$ is a $C_3$ to $C_8$ alkyl group, more preferably $C_4$ to $C_7$ alkyl group and n is a number from 3 to 8, more preferably 4 to 7.

Typical water insoluble ethers are di(alphamethyl benzyl) ether and diphenyl ether. Typical alcohols are phenoxyethanol and 3-morpholino-1,2-propanediol. Typical water insoluble nitro derivatives are nitro butane and nitrobenzene.

Suitable essential oils which can be used in the instant compositions are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Fernlol™, Florilys™, Geraniol, Geranyl Acetate, Geranyl Nitrile, Glidmint™ Mint oils, Glidox™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, lonone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo lonone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, Zestoral™.

The major class of compounds found to provide highly suitable cosurfactants for the instant cleaning compositions over temperature ranges extending from 5° C. to 43° C. for instance are water-soluble polyethylene glycols having a molecular weight of 150 to 1000, polypropylene glycol of the formula $HO(CH_3CHCH_2O)_nH$ wherein n is a number from 2 to 18, mixtures of polyethylene glycol and polypropylene glycol (Synalox) and mono and di $C_1$–$C_6$ alkyl ethers and esters of ethylene glycol and propylene glycol having the structural formulas $R(X)_nOH$, $R_1(X)_nOH$, $R(X)_nOR$, $R_1(X)_nOR_1$ and $R_1(X)_nOR$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1methoxy-2-propanol, 1methoxy-3-propanol, and 1methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

The low molecular weight amphiphile of the instant composition is a molecule composed of at least two parts which is capable of bonding with the polar solvent and the non-polar solvent. Increasing the molecular weight of the low molecular weight amphiphile increases its water/oil coupling ability which means less low molecular weight amphiphile is needed to couple the polar solvent and the non-polar solvent or weakly polar solvent. At least one part is essentially hydrophobic, with a Hansen partial polar and hydrogen bonding solubility parameters less than 5 $(MPa)^{1/2}$. At least one part is essentially water soluble, with Hansen partial hydrogen bonding solubility parameter equal or greater than 10 $(MPa)^{1/2}$.

To identify the hydrophilic and hydrophobic parts, the low molecular weight amphiphilic molecule (amphiphile) must be cut according to the following rules: The hydrophobic parts should not contain any nitrogen or oxygen atoms; the hydrophilic parts generally contain the hetero-atoms including the carbon atoms directly attached to an oxygen or nitrogen atom.

| Group | MW | d | p | H |
|---|---|---|---|---|
| $—CH_2—OH$ | 31 | 15.5 | 16.1 | 25.4 |
| $—CH_2—NH_2$ | 30 | 13.8 | 9.3 | 16.7 |
| $—CO—NH_2$ | 44 | 13 | 14.1 | 13.4 |
| $—CH_2—NH—CO—NH_2$ | 73 | 13.7 | 11.4 | 13.6 |
| $—CH_2—EO—OH$ | 75 | 14.9 | 3.1 | 17.5 |
| $—CH_2—EO_2—OH$ | 119 | 14.8 | 2.6 | 14.8 |
| $—CH_2—EO_3—OH$ | 163 | 14.7 | 2.1 | 13.3 |
| $—CH_2—EO_4—OH$ | 207 | 14.7 | 1.9 | 12.4 |
| $—COO—CH_3$ | 59 | 13.7 | 8.3 | 8 |
| $—CO—CH_3$ | ,43 | 16.5 | 17.9 | 6.8 |
| $—C_3H_7$ | 43 | 13.7 | 0 | 0 |
| $—C_4H_9$ | 57 | 14.1 | 0 | 0 |
| $—C_{10}H_{21}$ | 141 | 15.8 | 0 | 0 |

This table shows the solubility parameters for different groups. The first series can be used as the hydrophilic part of an amphiphile molecule, as the hydrogen bonding solubility parameter is always greater than 10. The last group can be used as the hydrophobic part of an amphiphile, as their polar and hydrogen bonding solubility parameters are below 1. The group in the middle (esters and ketones) cannot be used as a significant contribution to an amphiphile molecule. It is noteworthy that amphiphiles can contain ketone or ester functions, but these functions do not contribute directly to the amphiphile performance. d is the Hansen dispersion solubility parameter as measured at room temperature; p is the Hansen polar solubility parameter as measured at room temperature; H is the Hansen hydrogen bonding solubility parameter as measured at room temperature. In particular preferred low molecular weight amphiphiles, which are present at a concentration of about 5 to about 60 wt %, more preferably about 15 to about 40 wt %, are selected from the group consisting essentially of polyoxyethylene derivatives having the formula:

$$C_xH_{2x+1}—O—(CH_2CH_2—O)_y—H$$

wherein x and/or y is 1 to 6, more preferably 1 to 6, polyols having 4 to 8 carbon atoms, polyamines having 5 to 7 carbon atoms, polyamides having 5 to 7 carbon atoms, alkanols having 2 to 4 carbon atoms and alkylene glycol alkyl ethers having the formula:

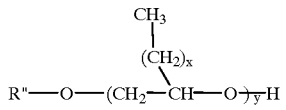

wherein R" is an alkylene group having about 1 to about 8 carbon atoms and x is 0 to 2 and y is about 1 to about 5. The molecular weight of the low molecular weight amphiphile is about 76 to about 300, more preferably about 100 to about 250. Especially preferred low molecular weight amphiphiles are propylene glycol n-butyl ether, tripropylene glycol n-butyl ether, propylene glycol t-butyl ether, propylene glycol methyl ether, hexanediol, diethylene glycol monobutyl ether, triethylene glycol monohexyl ether and tetraethylene glycol monohexylether and mixtures thereof such as propylene glycol n-butyl ether and propylene glycol methyl ether in a ratio of about 2:1 to about 1.5:1.

The instant compositions contain at least one solubilizing agent which can be sodium xylene sulfonate, sodium cumene sulfonate, a $C_{2-3}$ mono or dihydroxy alkanols such as ethanol, isopropanol and propylene glycol and mixtures thereof. The solubilizing agents are included in order to control low temperature cloud clear properties. Urea can be optionally employed in the instant composition as a supplemental solubilizing agent at a concentration of 0 to about 10 wt. %, more preferably about 0.5 wt. % to about 8 wt. %.

The instant composition can contain a $C_{12-14}$ alkyl monoalkanol amide such as lauryl monoalkanol amide and/or a $C_{12-14}$ alkyl dialkanol amide such as lauryl diethanol amide or cocodiethanol amide.

The water is present at a concentration of 40 wt. % to 90 wt. %.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Sodium bisulfite can be used as a color stabilizer at a concentration of 0.01 to 0.2 wt. %.

The present light duty liquid detergents such as dishwashing liquids are readily made by simple mixing methods from readily available components which, on storage, do not adversely affect the entire composition. Solubilizing agent such as ethanol, sodium chloride and/or sodium xylene or sodium xylene sulfonate are used to assist in solubilizing the surfactants. The viscosity of the light duty liquid composition desirably will be at least 100 centipoises (cps) at room temperature, but may be up to 4,000 centipoises as measured with a Brookfield Viscometer at 25° C. using a number 21 spindle rotating at 20 rpm with a small sample adapter.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

The compositions of Examples I to IV were made by mixing at 25° C. by simple stirring all the ingredients of each formula except for the isopentane until a homogeneous solution was formed. Then 90 wt. % of the mixed formula and 10 wt. % of isopentane were chilled in separate ice baths and added together into a chilled beaker and stirred at 40° F. to 45° F. for about one minute until the uniform solutions as represented in the listed formulas for Examples I to IV were obtained. The formulas listed in Examples I to IV represent the final mixed formulas in wt. % which contain the isopentane. The chilled mixed formulas of Examples I to IV was added to the open chamber of a Gaum Inc. laboratory bench top filler. The top of the filler is screwed on manually, and the filling stem is placed into the valve of the Exxel package (device of U.S. Pat. No. 4,964,540) or CCL container/MonoBloc. A compressed air driven piston forces the liquid in the filler chamber into the Exxel package or CCL container/MonoBloc. When filled, the Exxel package (or CCL container/MonoBloc) is removed from the filling stem. The Exxel valve assembly holds the liquid in the package (or bulb) until an actuator is applied and depressed.

The CCL container/MonoBloc is an ABS laminated pouch. The pouch is welded to a standard 1 inch aerosol valve. The laminated pouch and valve is inserted into an aluminum can. Compressed air or nitrogen is injected under the aerosol valve, then crimped. The compressed air or nitrogen surrounds the product filled pouch. When the actuator is depressed, the air exerts pressure on the pouch, providing the force required to discharge the product. All the air remains in the can, and is not released into the atmosphere.

After each filling operation, the Gaum filler was disassembled, cleaned, rinsed with cold tap water, dried, and re-assembled. The piston was lowered to its bottom position with vacuum. The open chamber was then ready to receive product/isopentane mixture for another filling operation.

EXAMPLE I

The following post foaming light duty liquid cleaning compositions in wt. % were made by the previously defined procedure:

| | A | B | C | D |
|---|---|---|---|---|
| NaLAS | 2.7 | | 24.04 | 5.54 |
| MgLAS | 8.12 | | | 5.54 |
| NH4 AEOS 1.3EO | 10.66 | | 8 | 17.19 |
| Na AEOS 1.3EO | | 13.23 | | |
| CAP Betaine | | 3.97 | | |
| CAP Amine Oxide | 5.7 | | | |
| APG 625 | 9 | 3.97 | 1.50 | 11.07 |
| LMMEA | | 2.65 | 2.22 | 1.98 |
| Neodol 1–9 | | 13.23 | | |
| Fragrance | 0.36 | 0.34 | 0.40 | 0.40 |
| Salts and solubilizer | 3.5 | 1.21 | 2.55 | 1.28 |
| Isopentane | 10 | 10 | 10 | 10 |
| Water | Balance | Balance | Balance | Balance |

The filled PET bulbs for the Formulas of Examples I to IV were maintained in a lab at room temperature. After 24 hours the filled Exxel packages were used for spray and post foaming tests. An actuator was applied, and a clean dish plate was used as the test surface. Product was sprayed on the dish surface and it was observed whether the sprayed liquid developed into a foam (post foaming) within 10 seconds and foamed to a minimum height of 0.5 cm. Experiments indicated that products with viscosity greater than 400 cps could not be sprayed through the Exxel package. High viscosity products would only ooze through the valve as a gel. Viscosities were measured at 25° C. using a programmable Brookfield DV2+ viscometer with small sample adapter.

EXAMPLE II

The following post foaming superwetting cleaning compositions in wt. % was made by the previously defined procedure:

| | E |
|---|---|
| Neodol 91-5 | 3.87 |
| D-limonene | 3.06 |
| C4 Alcohol 2EO | 7.47 |
| Perfume | 0.9 |
| Water | Balance |
| Post Foaming | yes |

EXAMPLE III

The following post foaming all purpose cleaning compositions in wt. % were made by the previously defined procedure:

| | F |
|---|---|
| Tall oil fatty acid | 13.66 |
| CAP AO + CAP hydroxysultaine | 1.366 |
| Isopentane | 10 |
| Salts and solubilizer | 6.75 |
| 45% KOH | 10 |
| Water | Balance |
| Post foaming | yes |

EXAMPLE IV

The following post foam microemulsion cleaning compositions in wt. % were made by the previously defined procedure:

| | G | H | I |
|---|---|---|---|
| NaLAS | | 7.2 | 7.2 |
| NH AEOS 2EO | | 0.9 | 0.9 |
| CAP Betaine | | 0.9 | 0.9 |
| Dioctyl sulfosuccinate | 0.59 | | |
| Neodol 91-2.5 | 2.22 | | |
| Neodol 91-5 | 8.89 | | |
| D-limonene | | 3.6 | |
| Isopar H | 4.5 | | |
| Dibutyl adipate | | | 3.6 |
| Isopentane | 10 | 10 | 10 |
| TPnB | 6.3 | | |
| C6 alcohol 3EO | | 10 | 10 |
| Fragrance | 0.45 | | |
| Post foaming | yes | yes | yes |
| Water | Balance | Balance | Balance |

What is claimed:

1. A post foaming all purpose cleaning composition comprising approximately by weight:

(a) 10% to 24% of a tall oil fatty acid;

(b) 2% to 10% of potassium hydroxide;

(c) 0.1% to 5% of amine oxide;

(d) 0.1% to 5% of a sultaine;

(e) 7% to 14% of isopentane; and (f) 75% to 95% of water.

* * * * *